US009643832B2

(12) United States Patent
Steward et al.

(10) Patent No.: US 9,643,832 B2
(45) Date of Patent: May 9, 2017

(54) REVERSIBLE DRAIN BASIN

(71) Applicant: Haws Corporation, Sparks, NV (US)

(72) Inventors: W. Jason Steward, Sparks, NV (US); Joshua D. Linn, Carson City, NV (US)

(73) Assignee: Haws Corporation, Sparks, NV (US)

( * ) Notice: Subject to any disclaimer, the term of this patent is extended or adjusted under 35 U.S.C. 154(b) by 56 days.

(21) Appl. No.: 14/671,448

(22) Filed: Mar. 27, 2015

(65) Prior Publication Data

US 2015/0275486 A1 Oct. 1, 2015

Related U.S. Application Data

(60) Provisional application No. 61/971,160, filed on Mar. 27, 2014.

(51) Int. Cl.

| | |
|---|---|
| ***B67D 1/16*** | (2006.01) |
| ***B67D 1/00*** | (2006.01) |
| ***E03B 9/20*** | (2006.01) |

(52) U.S. Cl.

CPC ..... *B67D 1/16* (2013.01); *B67D 1/0014* (2013.01); *E03B 9/20* (2013.01)

(58) Field of Classification Search

CPC ..... B67D 1/16; B67D 1/0014; E03B 9/20
USPC ..... 222/108
See application file for complete search history.

(56) References Cited

U.S. PATENT DOCUMENTS

| | | | | |
|---|---|---|---|---|
| 4,698,982 | A | 10/1987 | Laios et al. | |
| 4,782,667 | A * | 11/1988 | Kito | F25C 1/147 100/131 |
| 5,542,572 | A * | 8/1996 | Davis | B67D 1/16 141/86 |
| 6,234,193 | B1 | 5/2001 | Hobbs et al. | |
| 2009/0242075 | A1 | 10/2009 | Busick et al. | |

FOREIGN PATENT DOCUMENTS

| | | |
|---|---|---|
| GB | 2007501 | 5/1979 |

* cited by examiner

*Primary Examiner* — Janie Loeppke
(74) *Attorney, Agent, or Firm* — Lowry Blixseth LLP; Scott M. Lowry

(57) ABSTRACT

The reversible drain basin disclosed herein includes a longitudinally extending base having an inlet generally formed from one side of the base and an outlet generally formed from another side of the base and in fluid communication with the inlet via a passageway therebetween. An attachment mechanism associated with the base is configured to selectively reciprocally attach the reversible drain basin to a liquid supply system in a first forward position extending the outlet over a collection basin and a second rearward position extending the outlet a distance sufficient for engagement with a wall-hidden drain pipe without reorientation of the liquid supply system.

23 Claims, 3 Drawing Sheets

REVERSIBLE DRAIN BASIN

BACKGROUND OF THE INVENTION

The present invention generally relates to a reversible drain basin. More specifically, the present invention relates to a reversible drain basin selectively mountable to a bottle filler or liquid supply station in a first forward configuration over a drinking fountain or other liquid receptacle or in a second rearward configuration for connection to an in-wall drain pipe system.

Wall-mounted liquid supply stations (e.g., bottle-filling stations) are commonly used to provide building occupants with a mechanism to easily fill a drinking vessel (e.g., bottle, cup, mug, etc.) as this can sometimes be difficult with a standard water fountain. That is, a water fountain having a shallow drain basin or limited water pressure can make it challenging to sufficiently fill the drinking vessel. In this respect, bottle-filling stations known in the art include an alcove sized to receive the drinking vessel underneath a water dispenser and may have a grille or base to support the drinking vessel during filling. Water dispenses from the top of the alcove and into the drinking vessel, to fill the drinking vessel with water. A drain underneath the drinking vessel may channel spillage or overflow into an underlying water fountain for draining into a central plumbing system. There are a variety of drains known in the art for draining overflow or spillage from the bottle-filling station into such a drinking fountain. These conventional drains are typically only installable in one orientation and capable of channeling the spilled liquid in one direction (e.g., only into the water fountain). Importantly, conventional drains cannot be positioned in one orientation to channel liquid forward into the water fountain and/or positioned in a rearward orientation to channel liquid back into a drain pipe disposed within the wall. As such, the market for drains that mount in different orientations is limited in scope and content.

For example, U.S. Pat. No. 4,698,982 to Laios discloses an air conditioning unit that includes the ability to convert between horizontal air flow and vertical air flow. More specifically, the air conditioning unit includes a drain pan that collects water produced by air flowing over air conditioner coils. The condensate may then be removed from the drain pan via a threaded coupling to which a pipe or hose connects. The drain pan is designed to convert between horizontal and vertical positions depending on the orientation of the air conditioner. To change the position of the drain pan, it is necessary to remove and reconfigure the entire air conditioning unit. Importantly, the drain pan is not simply reversible by selectively removing a set of screws that connect the drain pan to a base part of the air conditioning unit. That is, the drain pan cannot be reversed without completely disassembling the air conditioner. Moreover, the entire air conditioning unit must also be reoriented to operate the drain in a "reverse" configuration. This is clearly problematic for many types of liquid supply systems (e.g., bottle filling stations) because the drain must be directly below the dispensing head (i.e., in the same orientation) in both the forward and reverse drain positions.

U.S. Pat. No. 6,234,193 to Hobbs discloses a reversible drain outlet box for installation in a wall for connection with water supply lines or drain lines. The drain outlet box is basically a molded plastic box having a generally symmetrical outer housing configured to attach between closely spaced studs. The outlet box may include several different connectors mounted to opposite surfaces to provide the installer with a variety of options for connecting the outlet box with either water supply lines or drain lines by rotating the box 180 degrees, depending on the structure and location of the aforementioned lines within the framed structure of a building. The box, however, does not otherwise permit a user to determine the draining direction (e.g., forward or rearward).

U.S. Publication No. 2009/0242075 to Busick discloses a combined water fountain and bottle filler combination. Specifically with respect to the drain mechanism, the bottle filler includes a grille underlying a water dispenser positioned within an alcove. The grille is configured to collect water and is coupled to a drainage pipe concealed within the casing of the bottle filler. Importantly, however, the casing is substantially flush with the wall such that the grille does not extend out therefrom an appreciable distance to drain into the underlying water fountain. In fact, even if one could reverse the orientation of the grille, the bottle filler still would not be able to drain into both the water fountain and the drainage pipe.

There exists, therefore, a significant need in the art for a reversible drain basin selectively mountable to a liquid supply system such as a bottle filler in either a forward position, which allows draining into a water fountain extending out from a wall, or a rearward position, which allows draining into a drain pipe located internally or within a wall, without disassembling and/or reorienting the liquid supply or bottle-filling station. The present invention fulfills these needs and provides further related advantages.

SUMMARY OF THE INVENTION

The reversible drain basin includes a longitudinally extending base having an inlet generally formed from one side of the base and an outlet generally formed from another side of the base and in fluid communication with the inlet via a passageway therebetween. An attachment mechanism associated with the base is configured to selectively reciprocally attach the reversible drain basin to a liquid supply system in a first forward position whereby the outlet extends out over a collection basin (e.g., in a drinking fountain) and a second rearward position extending the outlet a distance sufficient for engagement with a wall-hidden drain pipe, all without modifying the orientation of the liquid supply system. In one embodiment, the attachment mechanism may include a set of apertures symmetrically formed in the base, which align with a respective symmetrical coupling in the liquid supply system for reversible mounting thereto. Here, a set of screws may selectively slide through the apertures, thereby securing the drain basin to the bottom of the liquid supply system. Reversing the orientation of the drain basin is just a matter of removing the screws, rotating the drain basin approximately 180 degrees, and reinserting the screws so the drain basin is once again secured to the liquid supply system, albeit in a reverse configuration. Both when the reversible drain basin is in the first forward and second rearward position, the inlet is preferably positioned relatively vertically higher than the outlet. Although, the passageway may be angled and generally slope downwardly from the inlet to the outlet to help dispense water from the drain basin.

In alternatives of this embodiment, the drain basin preferably also includes an outlet having either a smooth outer diameter for selective slide-in engagement with a slip-joint connection or a threaded outer diameter for selective threaded engagement with the drain pipe. Since the inlet generally collects water from the liquid supply system (e.g., overflow, spillage, etc.), it may be preferred that the inlet is relatively larger than the outlet. Here, the passageway may generally funnel water from the inlet to the relatively narrower outlet. The inlet and the outlet may also extend vertically into the base before intersecting the passageway. Additionally, the reversible drain basin may include a generally triangular outer housing having a pair of vertical sidewall segments converging to a filleted intersection point at a front of the base and generally include a plastic shell-shape.

In an alternative embodiment, the reversible drain basin disclosed herein may include a base having a generally symmetrical mounting surface with an inlet formed therefrom and positioned relative to a liquid supply system for selected reception of water dispensed therefrom. A coupling associated with the mounting surface is configured to selectively reciprocally attach the reversible drain basin to the liquid supply system in a first forward position extending an outlet over a collection basin and a second rearward position extending the outlet a distance sufficient for engagement with a wall-hidden drain pipe. In this embodiment, the inlet remains in a position relatively vertically higher than the outlet when the reversible drain basin is both in the first forward and second rearward positions. Additionally, a passageway extends between the inlet and the outlet to provide fluid communication therebetween. This allows the drain basin to dispense water from the drain basin to the collection basin when in the first forward position or to the drain pipe when in the second rearward position.

In this embodiment, the horizontal mounting surface preferably flush mounts to the liquid supply system in both the first forward and the second rearward positions. This provides mounting continuity between the reversible drain basin and the liquid supply system. Here, the coupling includes a set of apertures symmetrically disposed about the mounting surface. The apertures align with a respective symmetrical attachment mechanism of the liquid supply system so that the drain basin can be selectively removed reattached to the liquid supply system in a reversed configuration without disassembly or reorientation of the liquid supply system. For example, the reversible drain basin may universally attach to the liquid supply system at 180 degree intervals. In a particularly preferred embodiment, the liquid supply system is a wall-mounted bottle filler and the outlet has a diameter sized for selective engagement with a 1¼" slip joint waste fitting.

In another embodiment, the reversible drain basin includes a symmetrical mounting surface with an inlet formed therefrom. The inlet is preferably positioned relative to a liquid supply system for selected reception of water dispensed therefrom. A funnel passageway extends through the body of the reversible drain basin and fluidly couples the inlet to a dispense outlet. A symmetrical set of attachment apertures formed in the symmetrical mounting surface flush mount the reversible drain basin to the liquid supply system in a first forward position whereby the dispense outlet extends over a collection basin. In a second, reverse configuration, the reverse drain basin flush mounts to the liquid supply system in a second rearward position whereby the dispense outlet extends out into a position for engagement with, e.g., a 1¼" slip joint waste fitting. Preferably, the reversible drain basin can be selectively attached to the liquid supply system in the first forward and second rearward positions without actually disassembling or otherwise reorienting the liquid supply system. To this end, the attachment mechanism preferably reciprocally couples the reversible drain basin to a common coupling in the liquid supply system at a 180 degree interval.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
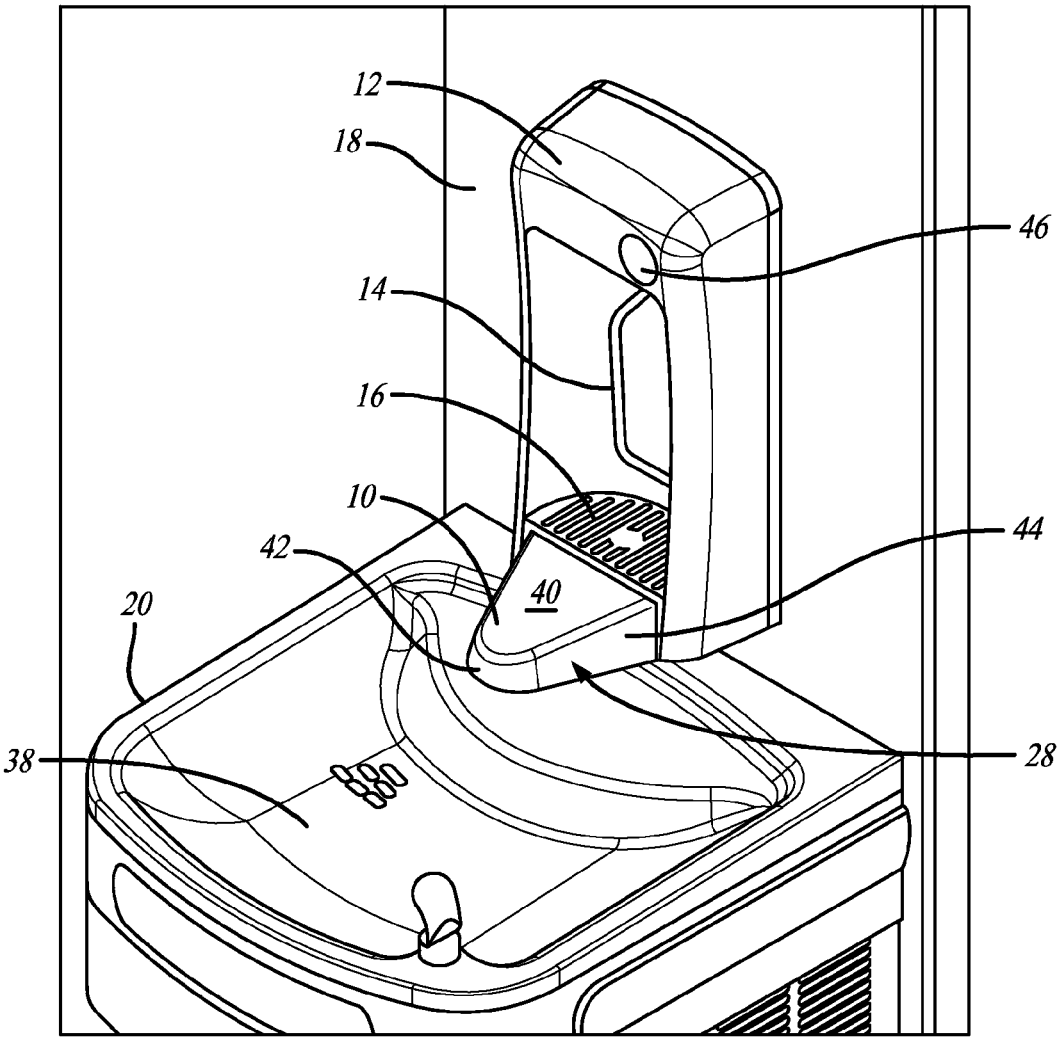
FIG. 1 is a perspective view of one embodiment of a reversible drain basin disclosed herein, the reversible drain basin being forward mounted to a bottle filler for draining into an underlying water fountain.
Figure 2:
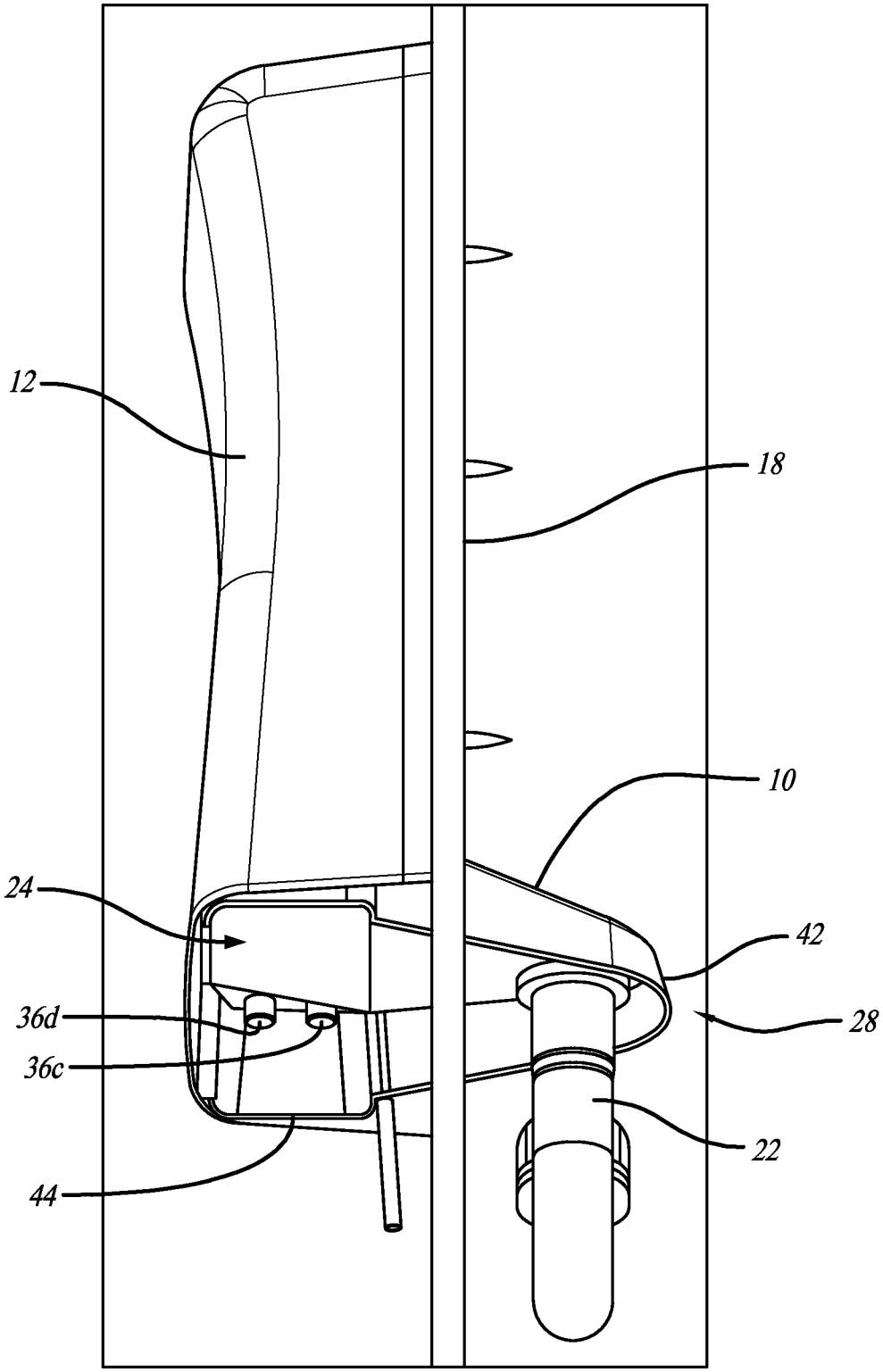
FIG. 2 is a perspective view of the reversible drain basin of FIG. 1, the reversible drain basin being rearward mounted to the bottle filler for draining liquid into a drain pipe.

As shown in the drawings for the purposes of illustration, the present disclosure for a reversible drain basin is referred to generally by the reference numeral 10 in FIGS. 1-4. In one embodiment, the reversible drain basin 10 as disclosed herein preferably attaches to a wall-mounted liquid supply station, such as a bottle filler 12 shown in FIG. 1, or other comparable liquid delivery device or system. The reversible drain basin 10 is designed to safely and effectively drain water from the bottle filler 12 in at least forward or rearward configurations, as disclosed herein. More specifically, the bottle filler 12 includes an alcove 14 having a porous bottom surface or base 16 (e.g., a grille) for supporting a container such as a bottle, cup mug, etc. to be filled by water or some other liquid dispensed from the bottle filter 12. The bottle filer 12 may be recessed into a wall 18 and mounted flush therewith, or the bottle filler 12 may be partially mounted within or simply externally attached to the wall 18 as shown in FIG. 1. As such, in one configuration, the reversible drain basin 10 is designed to channel liquid spilled on to the porous base 16 into an underlying receptacle such as the water fountain 20 shown in FIG. 1 extending out from the flush surface of the wall 18 or, in another configuration, into a drain pipe 22 connected to a central plumbing system within the interior of the wall 18 as shown in FIG. 2. The water fountain 20 may also be an electric water cooler or other device known in the art for collecting and draining liquid. The drain pipe 22 is preferably a pipe (e.g., a tailpiece or a P-trap) directly connected to the internal plumbing system of a building or comparable structure, and generally hidden direct view.

Importantly, the reversible drain basin 10 is mountable in both a forward position (FIG. 1), which allows liquid to drain into the water fountain 20 external to the wall 18, and in a rearward position (FIG. 2), which allows liquid to flow into the drain pipe 22 located internally within the wall 18. In this respect, the reversible drain basin 10 increases the flexibility and use of the bottle filler 12—i.e., the reversible drain basin 10 allows the liquid bottle filler 12 to mount to any wall having either the water fountain 20 underneath or the drain pipe 22 plumbed within the interior of the wall 18. In instances where the water fountain 20 is available, the drain basin 10 can be forward mounted, thereby eliminating the need to directly connect the drain basin 10 to a central plumbing system. In other instances where the water fountain 20 is unavailable, the bottle filler 12 can still be wall-mounted because the drain basin 10 can be rearward mounted to couple to an internal drain pipe 22 within the wall 18. This feature provides much greater mounting flexibility than conventional drain basin devices.

As illustrated in FIGS. 1-4, the reversible drain basin 10 is generally shell-shaped and preferably made from a plastic material to ensure longevity and ease of manufacture. More specifically, the reversible drain basin 10 generally includes an inlet portion 24 having an inlet 26 formed therein for receiving liquid passing through the porous base 16, and an outlet portion 28 having an outlet 30 for discharging liquid from the drain basin 10. A liquid conduit or passageway 32 extends through the interior of the drain basin 10 and couples the inlet 26 to the outlet 30. The inlet portion 26 mounts underneath the porous bottom surface or base 16 of the liquid bottle filler 12, while the outlet portion 28 projects out and away from the liquid bottle filler 12, such as over the water fountain 20 (FIG. 1) or within the wall 18 for direct connection to the building plumbing system by way of the drain pipe 22. The inlet 26 is disposed generally vertically higher than the outlet 30 so liquid entering the drain basin 10 flows downwardly through the passageway 32 under the influence of gravity. Furthermore, the inlet 26 is preferably approximately the size of the porous base 16 (FIG. 1) to ensure liquid spilled within the alcove 14 enters the reversible drain basin 10. In this respect, a larger surface area opening of the inlet 26 should correspond with more efficient capturing and draining of liquid spilled within the alcove 14. Although, in other embodiments, the inlet 26 may be a generally rectangular opening sized to approximately 80%-90% of the area of the porous base 16. Of course, the inlet 26 may have any shape or size known in the art so long as the inlet 26 is able to drain liquid out from the porous base 16. Smaller sizes are less preferred as it decreases the area the inlet 26 may capture liquid from the bottle filler 12.

Liquid overflow or spillage within the alcove 14 drains through the porous base 16 of the bottle filler 12 and into the inlet 26 for travel into the passageway 32 en-route to being dispensed therefrom through the outlet 30. The outlet 30 is preferably relatively smaller than the inlet 26 (e.g., 20-30% of the width). As such, the reversible drain basin 10 captures or collects liquid overflow or spillage in the alcove 14 using the larger area inlet 26, before funneling the liquid into a smaller area for point delivery or dispensing of drained liquid through the outlet 30. In a particularly preferred embodiment, the outlet 30 is configured to interface with a 1¼" slip joint waste fitting for connection to a hard-plumbed drain, such as the drain pipe 22.

Figure 3:
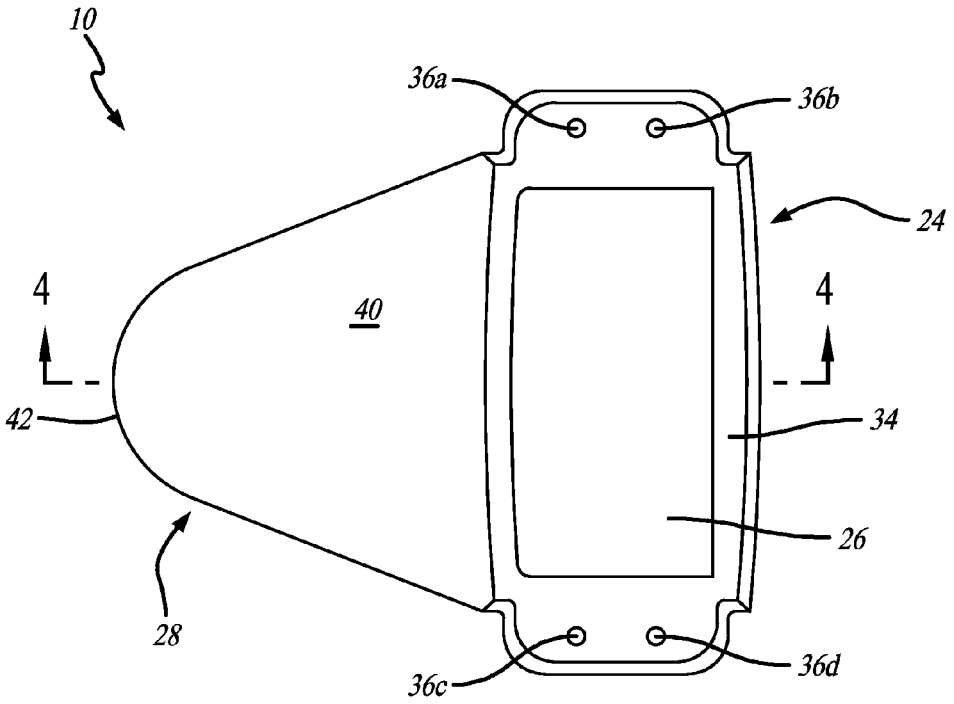
FIG. 3 is a top plan view of the reversible drain basin of FIGS. 1-2, illustrating the reversible geometry thereof.

As illustrated in FIG. 3, the inlet portion 24 has reversible geometry for mounting to the liquid bottle filler 12 in both the forward and rearward positions. This reversible geometry allows the inlet portion 24 to mount to the liquid bottle filler 12 in the same general manner (e.g., the inlet 26 being vertically higher than the outlet 30) regardless of whether the outlet portion 28 extends forward from the wall 18 (FIG. 1) or rearward into the wall 18 (FIG. 2). Moreover, the reversible drain basin 10 can also mount in the forward and rearward positions without changing the position or orientation of the liquid bottle filler 12. Specifically, in one embodiment, it may be possible to remove and reverse the orientation of the reversible drain basin 10 without detaching the liquid bottle filler 12 from the wall 18. Here, the reversible drain basin 10 need only be detached from the bottle filler 12, rotated 180 degrees, and reattached to the bottle filler 12 in accordance with the embodiments described herein.

The embodiment shown in FIG. 3 more specifically illustrates that the inlet portion 24 of the reversible drain basin 10 is of a generally rectangular and symmetrical configuration. Of course, a person of ordinary skill in the art will readily recognize that the inlet portion 24 could be of any shape or size as long as it permits symmetrical mounting to the bottle filler 12, e.g., about a center horizontal axis such as line 4-4 in FIG. 3, as described herein. Additionally, a top surface 34 of the inlet portion 24 is preferably generally flat (i.e., horizontal when mounted), although the top surface 34 may have any symmetric topography that conforms to the liquid bottle filler 12. In this respect, the inlet portion 24 preferably includes a symmetric shape and topography to ensure proper mating between the reversible drain basin 10 and the liquid bottle filler 12, both in the forward and rearward positions.

In the preferred embodiment shown best in FIG. 3, the inlet portion 24 further includes a plurality of mounting holes 36 for attaching the reversible drain basin 10 to the liquid bottle filler 12 via screws, bolts, or other similar hardware. As illustrated in FIG. 3, one embodiment of the inlet portion 24 includes four mounting holes 36*a*, 36*b*, 36*c*, and 36*d*, where the mounting holes 36*a* and 36*b* are symmetrically disposed on one side of the inlet 26 and the mounting holes 36*c* and 36*d* are symmetrically disposed on the other side. The relative symmetric mounting of the holes 36*a*-36*d* permits reversible mounting of the drain basin 10 relative to the bottle filler 12. That is, each set of the mounting holes 36*a*, 36*b* and 36*c*, 36*d* reciprocally mount underneath the bottle filler 12 when in the forward or rearward position. Of course, the inlet portion 24 may include any number of the mounting holes 36 or other comparable attachment mechanisms that permit selective attachment, removal and reverse mounting of the drain basin 10 relative to the bottle filler 12. For example, in alternative embodiments, the inlet portion 24 may connect to the liquid bottle filler 12 using a snap-fit engagement mechanism (e.g., elastically-deformable hooks that slide into channels and lock therein), an adhesive, a slide-fit engagement mechanism, or other temporary locking mechanisms known in the art.

Figure 4:
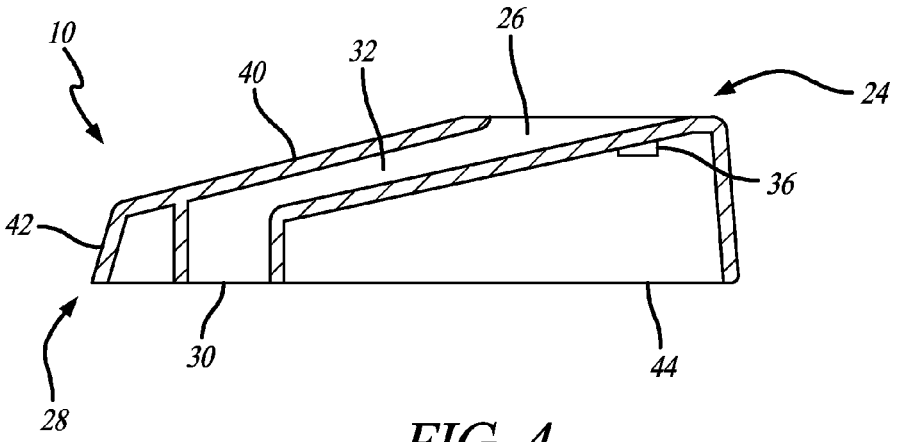
FIG. 4 is a cross-sectional view of the reversible drain basin taken generally about line 4-4 in FIG. 3, further illustrating the internal structural configuration of the basin.

FIG. 4 more specifically illustrates the internal features of the reversible drain basin 10, including the passageway 32. Preferably, the passageway 32 is generally an internal tunnel that slopes downwardly from the inlet 26 to the outlet 30 to facilitate gravity-based liquid flow therethrough. Furthermore, as shown in FIG. 4, the passageway 32 intersects the top surface 34 of the inlet portion 24 at an angle to further facilitate downward flow of liquid from the porous base 16/inlet portion 24. In one embodiment, the inlet 26 may effectively have no depth, and is simply just an opening in the inlet portion 24 that generally follows the geometry of the porous base 16. This configuration may reduce the manufacturing complexity and cost by simplifying the mold used to make the reversible drain basin 10. Alternatively, the inlet 26 may extend vertically into the inlet portion 24 before intersecting with the passageway 32. The opposite end of the passageway 32 intersects with the generally upwardly extending vertical outlet 30. Preferably, the outlet 30 extends up into the outlet portion 28 by a sufficient depth to permit engagement with the drain pipe 22, as described herein.

The outlet portion 28 extends generally outward from the inlet portion 24 and may slope downwardly about a top surface 40 thereof for draining liquid from the liquid bottle filler 12 into a collection basin 38 of the water fountain 20 or into the drain pipe 22 (as coupled to a central plumbing system). The outlet portion 28 preferably extends far enough to position the outlet 30 over the collection basin 38 when disposed in the forward position and far enough inward to connect to the drain pipe 22 inside the wall 18 when in the rearward position. Importantly, conventional drains typically do not extend far enough outward (if at all) from the bottle filler 12 to provide such connectivity, particularly with respect to the drain pipe 22 within the wall 18. The outwardly extending length of the outlet portion 28 facilitates the reversibility of the drain basin 10 by allowing proper draining in both the forward and rearward positions, as mentioned above.

In one embodiment, the outlet portion 28 has a generally triangular shape where the vertical sides of the outlet portion 28 converge inwardly from the inlet portion 24 to a filleted (i.e., rounded) intersection point at a front surface 42 thereof. This shape may be preferred to funnel liquid entering a relative wide inlet 26 down to a relatively narrower outlet 30 (e.g., 20-30% the width), which provides a narrow, concentrated liquid discharge to the water fountain 20 when in the forward position or to the drain pipe 22 when in the rearward position. Alternatively, the outlet portion 28 may be rectangular, hemispherical, hemi-hexagonal, or have any shape known, as long as the outlet 30 extends outwardly a sufficient distance to permit draining as described herein.

As briefly mentioned above, the top surface 40 may slope downwardly, and may generally follow the downward slope of the passageway 32. In the embodiment shown in FIG. 4, the downwardly sloping angle of the top surface 40 is parallel with the downwardly sloping angle of the passageway 32. This aspect of the reversible drain basin 10 may reduce manufacturing complexity and cost (e.g., simpler and less expensive molds) since the downwardly sloping angles of the passageway 32 and the top surface 40 are generally uniform. Alternatively, the top surface 40 may extend outwardly at less of an angle, or it may be horizontal.

As mentioned above, the outlet 30 extends generally vertically upward from the bottom of the outlet portion 28 and into the body of the drain basin 10 for eventual intersection with the downwardly-sloping passageway 32, as shown in FIG. 4. This, as described above, forms a continuous fluid pathway through the reversible drain basin 10 between the inlet 26 and the outlet 30. Preferably, the outlet 30 generally forms a pipe-like conduit having a 1¼ inch outer diameter to facilitate connection with a standard slip joint waste fitting such as a tail pipe or P-trap commonly used with building plumbing systems. Further, the exterior surface of the outlet 30 preferably includes male threads disposed thereon for connection to the aforementioned plumbing system. These threads may be machine screw threads, acme threads, or any other type of thread known in the art. Alternatively, the outlet 30 may have female threads for connection to a male connection, or the outlet 30 may have a smooth outer surface for slide-fit connection with a pipe. One may use an adhesive with the outlet 30 and the pipe for a more permanent connection. Of course, the outlet 30 may be any size or shape known in the art, but it is preferred that the outlet 30 can selectively couple to the drain pipe 22. Additionally, the outlet 30 need not be exactly vertical. In this respect, the outlet 30 may extend into the outlet portion 28 at an angle and/or intersect the passageway 32 at an angle. Again, the angled orientation of the outlet 30 preferably does not prevent connection to the drain pipe 22. The outlet 30 is also preferably generally circular and sized to accommodate standard piping diameters.

In the embodiment shown in FIGS. 1-4, the bottoms of one or more sidewall segments 44 are continuous and generally horizontal when the reversible drain basin 10 is mounted to the bottle filler 12. Here, the bottom of the sidewall segments 44 are flush with the bottom of the bottle filler 12 to form a smooth continuous bottom edge, as illustrated in FIGS. 1 and 2. Alternatively, the reversible drain basin 10 may have angled bottom surfaces on the sidewall segments 44 to form a generally discontinuous bottom edge with the liquid bottle filler 12.

Preferably, the reversible drain basin 10 is constructed from a suitable polymer material such as polyvinyl chloride (PVC), acrylonitrile butadiene styrene (ABS), or polypropylene via injection molding. Alternatively, the reversible drain basin 10 may be constructed of a corrosion-resistant metal such as aluminum or galvanized steel. Although, the reversible drain basin 10 may be constructed from any suitable material or by any suitable manufacturing method known in the art.

Once mated to the bottle filler 12, the reversible drain basin 10 drains liquid from the porous base 16 (e.g., as dispensed by the bottle filler 12 or spilled during filling) into the underlying water fountain 20 or into the connected drain pipe 22. In operation, a user places a container (e.g., water bottle, cup, mug, etc.) on the porous bottom surface or base 16 for filling thereof by depressing an externally accessible button 46 to activate the liquid bottle filler 12. The bottle filler 12 then activates and water dispenses from a nozzle (not shown) in the alcove 14 and preferably into the bottle. Water that spills out from the bottle, whether by overflow or otherwise, first lands on the porous bottom surface or base 16 and seeps down into the inlet 26. From there, the liquid flows through the angled passageway 32 to the outlet 30, where the liquid is dispensed into the water fountain 20 or the drain pipe 22, depending on the configuration of the reversible drain basin 10. In FIG. 1, the liquid drains into the collection basin 38 en-route to a plumbing system connected internally to the water fountain 20. Alternatively, in FIG. 2, the reversible drain basin 10 discharges liquid from the outlet 30 directly into a plumbing system via the drain pipe 22. The reversible drain basin 10, unlike conventional drain devices, provides at least two different configurations to drain water discharged from the liquid supply system 12.

Although several embodiments have been described in detail for purposes of illustration, various modifications may be made without departing from the scope and spirit of the invention. Accordingly, the invention is not to be limited, except as by the appended claims.

What is claimed is:

1. A reversible drain basin, comprising:

a longitudinally extending base;

an inlet comprising a horizontal opening generally formed from one side of the base;

an outlet generally formed from another side of the base and in fluid communication with the inlet via an enclosed and downwardly sloping passageway therebetween; and an attachment mechanism associated with the base proximate the horizontal opening of the inlet and distal the outlet, the attachment mechanism configured to selectively reciprocally attach the reversible drain basin to a liquid supply system in a first forward position extending the outlet over a collection basin and a second rearward position extending the outlet a distance sufficient for engagement with a wall-hidden drain pipe without reorientation of the liquid supply system.

2. The reversible drain basin of claim 1, wherein the attachment mechanism comprises a set of apertures symmetrically formed in the base.

3. The reversible drain basin of claim 2, wherein the set of apertures align with a respective symmetrical coupling in the liquid supply system for reversible mounting thereto.

4. The reversible drain basin of claim 1, wherein the inlet is positioned relatively vertically higher than the outlet when the reversible drain basin is in both the first forward and second rearward positions.

5. The reversible drain basin of claim 4, wherein the passageway comprises an angled passageway generally sloping downwardly from the inlet to the outlet.

6. The reversible drain basin of claim 1, wherein the outlet includes a smooth outer diameter for selective slide-in engagement with a slip-joint connection or a threaded outer diameter for selective threaded engagement with the drain pipe.

7. The reversible drain basin of claim 1, wherein the passageway comprises a funnel.

8. The reversible drain basin of claim 1, wherein the inlet and the outlet extend vertically into the base before intersecting the passageway.

9. The reversible drain basin of claim 1, wherein the reversible drain basin includes a generally triangular outer housing having a pair of vertical sidewall segments converging to a filleted intersection point at a front of the base.

10. The reversible drain basin of claim 1, wherein the reversible drain basin comprises a plastic shell-shape.

11. The reversible drain basin of claim 1, wherein the inlet is relatively larger than the outlet.

12. A reversible drain basin, comprising:

a base having a generally symmetrical mounting surface;

a horizontal inlet formed from the base and configured to be positioned relative to a liquid supply system for selected reception of water dispensed therefrom;

a coupling associated with the mounting surface and configured to selectively reciprocally attach the reversible drain basin to the liquid supply system in a first forward position extending an outlet over a collection basin and a second rearward position extending the outlet a distance sufficient for engagement with a wall-hidden drain pipe, wherein the inlet remains in a position relatively vertically higher than the outlet when the reversible drain basin is both in the first forward and second rearward positions; and an enclosed passageway extending between the horizontal inlet and the outlet to provide fluid communication therebetween and dispensing of water from the drain basin to the collection basin when in the first forward position or to the drain pipe when in the second rearward position.

13. The reversible drain basin of claim 12, wherein the horizontal mounting surface flush mounts to the liquid supply system in both the first forward and the second rearward positions.

14. The reversible drain basin of claim 12, wherein the coupling comprises a set of apertures symmetrically disposed about the mounting surface.

15. The reversible drain basin of claim 14, wherein the set of apertures align with a respective symmetrical attachment mechanism of the liquid supply system for reversible mounting thereto.

16. The reversible drain basin of claim 12, wherein the outlet comprises a diameter sized for selective engagement with a 1¼" slip joint waste fitting.

17. The reversible drain basin of claim 12, wherein the liquid supply system comprises a wall-mounted bottle filler.

18. The reversible drain basin of claim 12, wherein the coupling permits selected removal and reoriented attachment of the reversible drain basin to the liquid supply system at 180 degree intervals without reorientation of the liquid supply system.

19. A reversible drain basin, comprising:

a symmetrical mounting surface;

an inlet formed from the mounting surface and configured to be positioned relative to a liquid supply system for selected reception of water dispensed therefrom;

an enclosed funnel passageway extending through the body of the reversible drain basin and fluidly coupling the inlet to a dispense outlet, the dispense outlet distal the mounting surface relative to the inlet; and a symmetrical set of horizontal attachment apertures formed in the symmetrical mounting surface to flush mount the reversible drain basin to the liquid supply system in a first forward position extending the dispense outlet over a collection basin and to flush mount the reversible drain basin to the liquid supply system in a second rearward position extending the dispense outlet into a position for engagement with a 1¼" slip joint waste fitting without disassembly of the liquid supply system.

20. The reversible drain basin of claim 19, wherein the attachment mechanism reciprocally couples the reversible drain basin to a common coupling in the liquid supply system at a 180 degree interval.

21. The reversible drain basin of claim 19, wherein the symmetrical set of horizontal attachment apertures are disposed about a perimeter of the inlet comprising a horizontal opening having circumferential generally vertical sidewalls that transition into the enclosed funnel passageway leading to the dispense outlet.

22. The reversible drain basin of claim 12, wherein a width of the base converges from a generally rectangular shape proximate the inlet to a generally triangular shape having a filleted front proximate the outlet.

23. The reversible drain basin of claim 22, wherein the passageway terminates into the outlet formed underneath the filleted front.

* * * * *